United States Patent [19]

Miles

[11] 3,998,428

[45] Dec. 21, 1976

[54] WELL PIPE EXTRACTOR AND INSTALLER

[76] Inventor: William B. Miles, P.O. Box 529, Bedford, Va. 24523

[22] Filed: Nov. 18, 1975

[21] Appl. No.: 633,158

[52] U.S. Cl. ..... 254/29 R
[51] Int. Cl.[2] ..... E21B 9/00
[58] Field of Search ..... 254/29 R, 30, 31, 106

[56] References Cited

UNITED STATES PATENTS

| | | | |
|---|---|---|---|
| 976,600 | 11/1910 | Rhodes | 254/29 R |
| 1,147,080 | 7/1915 | Dunlap et al. | 254/31 |
| 2,433,477 | 12/1947 | O'Quinn et al. | 254/30 |
| 2,519,680 | 8/1950 | Macumber | 254/29 R |
| 2,967,044 | 1/1961 | Corcreham et al. | 254/30 |
| 3,834,668 | 9/1974 | Casey | 254/29 |

*Primary Examiner*—Al Lawrence Smith
*Assistant Examiner*—Robert C. Watson
*Attorney, Agent, or Firm*—Watson, Cole, Grindle & Watson

[57] ABSTRACT

An apparatus for both extracting and installing well pipes respectively from and into the ground includes first and second well pipe gripping devices each having cooperating jaws of arcuate configuration with gripping teeth thereon. The jaws are eccentrically mounted and spring biased for closing rotation toward one another for clamping the well pipe in only one direction causing the jaws to close. And, the jaws open in an opposite direction for permitting relative movement of the well pipe. One of the devices is fixedly disposed near the ground while the other is mounted for vertical movement for extracting the well pipe. The fixed device clamps the pipe against downward movement while the movable device is lowered to again clamp the pipe for further extraction. Likewise, a guiding of the well pipe while being installed into the ground under its own weight is effected as the movable device is lowered in clamping engagement therewith. The jaws of the fixed device are opened during lowering and, while the movable device is being elevated to grasp another section of the well pipe, its jaws are opened while the jaws of the fixed device are closed after which another lowering cycle commences.

5 Claims, 12 Drawing Figures

WELL PIPE EXTRACTOR AND INSTALLER

BACKGROUND OF THE INVENTION

This invention relates generally to a well pipe apparatus, and more particularly to such an apparatus for use in both extracting the well pipe from the ground or for guiding a well pipe into the ground while it is being lowered under its own weight.

Heretofore it has been customary to extract a well pipe from a well bore as a workman manually pulls up the well pipe with the use of his pipe wrench while another workman clamps the pipe at the ground level with his pipe wrench to prevent a lowering of the pipe back into the bore. The first workman again clamps the pipe at a lower section to continue the extraction process. This is not only a cumbersome and a costly labor approach but it is ineffective as well. Slippage of the well pipe sometimes occurs as it is being incrementally pulled up. Also, it is difficult to lower a new well pipe into a well bore by such a technique without preventing the pipe from being lowered into the ground at an uncontrolled rate. Various apparatus for well pipe extraction have been devised although each of them is of a rather complex construction in their design of the gripping jaws and in the means employed in releasing same to effect an extraction and a lowering of well pipes.

SUMMARY OF THE INVENTION

It is therefore an object to the present invention to provide a well pipe extractor and installer of a simple and economical construction yet highly effective in easily extracting well pipes from well bores and in installing well pipes into the ground.

Another object of the invention is to provide such an apparatus for extracting a well pipe without the danger of slippage while portions thereof are being gripped during the extraction process.

In carrying out this invention first and second gripping devices are respectively mounted fixedly and vertically moveable on the apparatus, each such device having opposing cammed gripping jaws capable of clamping the well pipe against downward movement relative thereto. Accordingly, the moveable gripping device clamps the well pipe and extracts a portion thereof as this device is elevated. The fixed gripping device thereafter clamps the pipe for preventing it from falling back into the ground while the moveable device is lowered to again clamp the well pipe for further extraction. Similarly, installation is effected as the moveable device is lowered while in gripping engagement with the well pipe during its descent into the well bore under its own weight. The fixed gripping device is at the same time opened to permit such lowering and is closed to clamp the pipe against further lowering once the moveable device lowers a desired section of the pipe. The moveable device may thereafter be raised and again lowered in clamping engagement with the pipe while the fixed device is opened to permit passage of the pipe therethrough. The opposing gripping jaws for each device are biased for inward closing movement and are designed as having arcuately shaped side edges from which gripping teeth radially extend inwardly to thereby permit well pipes of various diameters to be effectively raised and lowered.

DESCRIPTION OF THE PREFERRED EMBODIMENT

Figure 1:
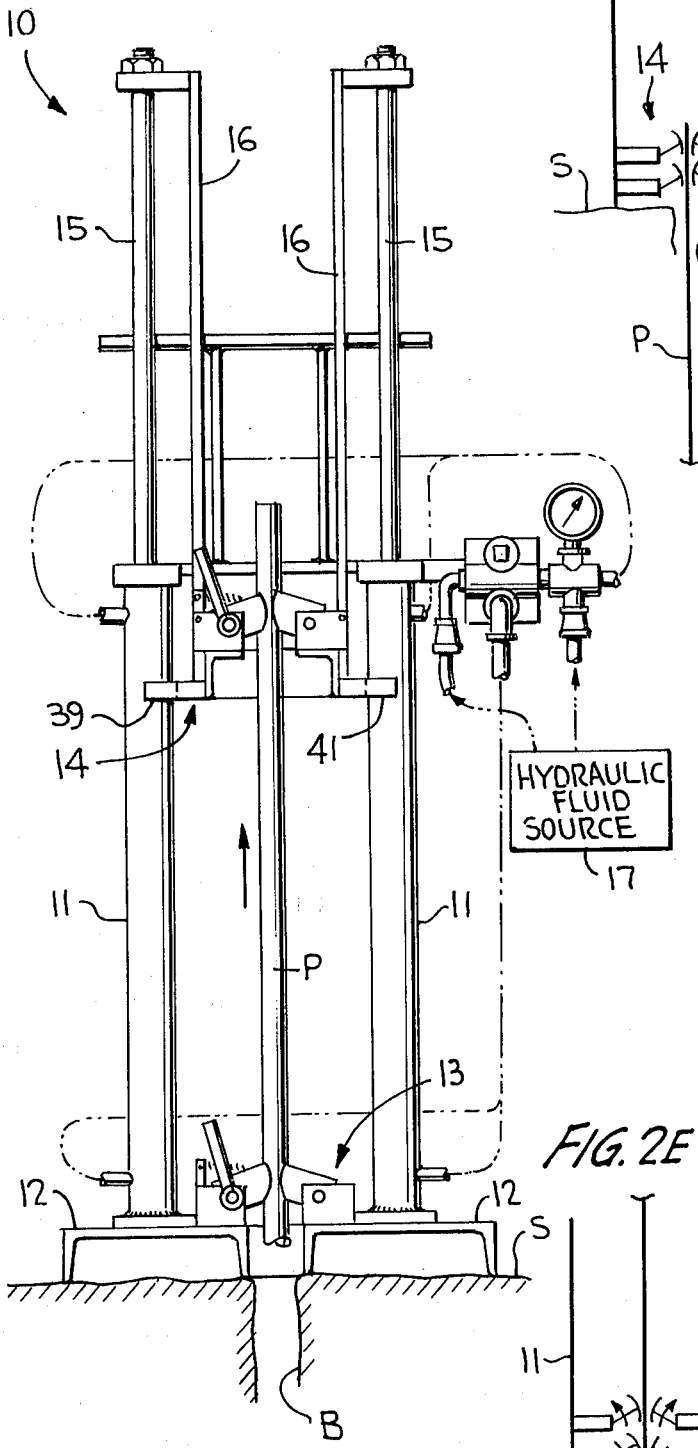
FIG. 1 is a side elevational view of the apparatus according to the invention.

Turning now to the drawings wherein like reference characters refer to like and corresponding parts throughout the several views, the present apparatus generally designated 10 is shown in FIG. 1 as comprising a vertical support structure defining a stand having vertical uprights 11 comprising hydraulic cylinders. Base members 12 are fixedly mounted at the lower ends of the uprights as by welding or the like so as to conveniently support the apparatus on a ground surface S. A first or stationary gripping device 13 is fixedly mounted on the apparatus at the lower end thereof, and another gripping device 14 similar to device 13 is mounted on the apparatus for movement along uprights 11. Hydraulic pistons 15 are mounted for movement within cylinders 11, and an upper end of each piston is connected to gripping device 14 by means of support bars 16. The pistons are made to extend into and retract from their respective hydraulic cylinders by means of suitable hydraulic piping shown schematically in FIG. 1 to which hydraulic fluid under pressure is directed from a source 17 in any normal manner.

Figure 3:
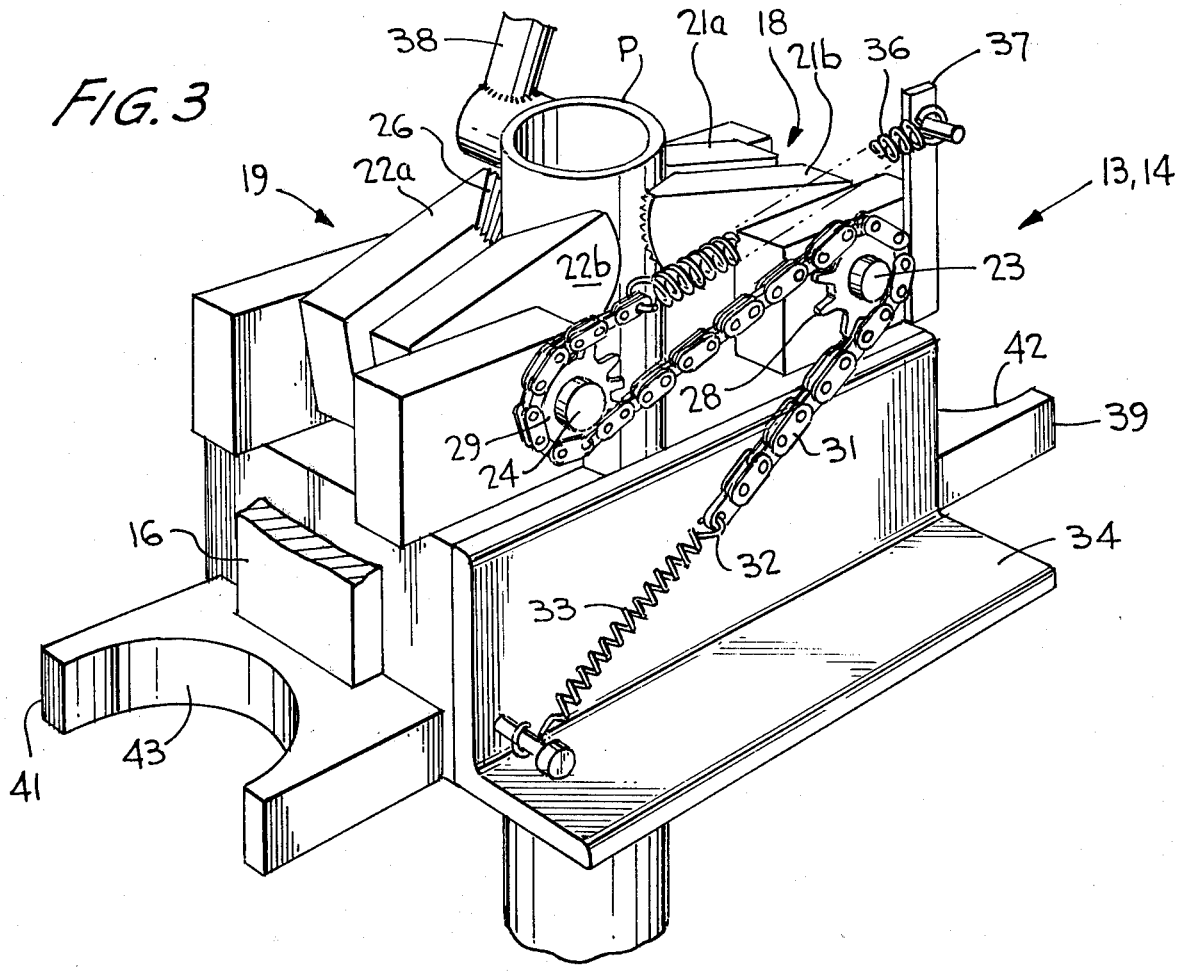
FIG. 3 is a perspective view of a gripping device used with the apparatus of the invention.
Figure 4:
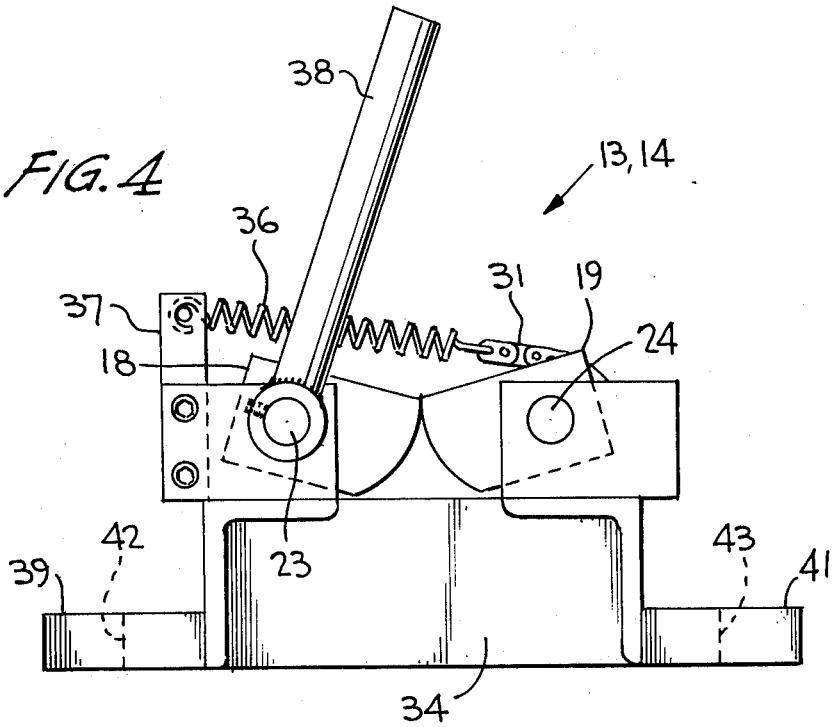
FIGS. 4 and 5 are rear elevational views of the device of FIG. 3 respectively showing closed gripping jaws relative to each other and relative to a well pipe clamped therebetween.
Figure 5:
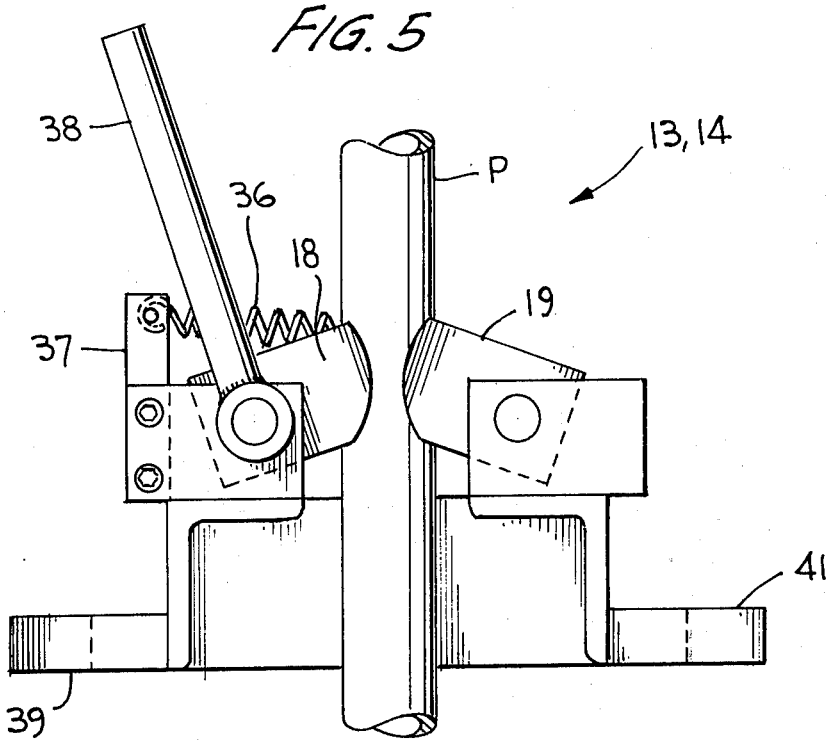
Figure 6:
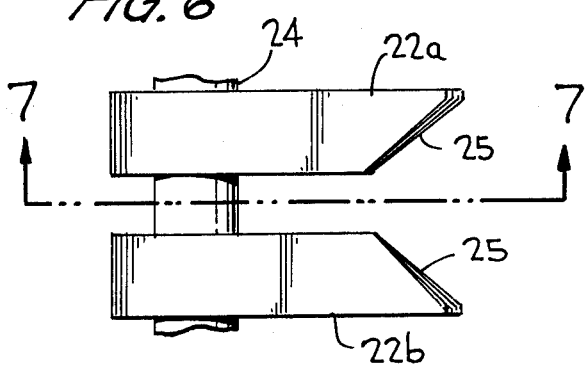
FIG. 6 is a top plan view of one of the opposed gripping jaws of the FIG. 3 device.
Figure 7:
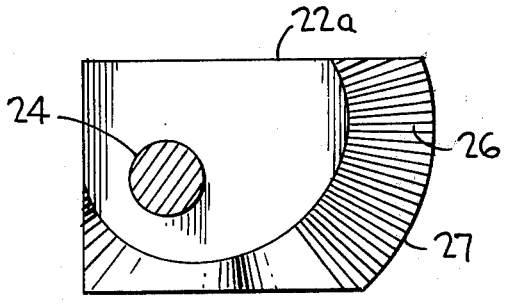
FIG. 7 is a side elevational view of one of the gripping jaws showing the gripping teeth design.

The well pipe gripping devices 13 and 14 are identical, and a typical device is shown in FIG. 3. Reference is also made to FIGS. 4 and 5 wherein it can be seen that each device includes a pair of opposed gripping jaws 18 and 19 each including pairs of elements **21*a*, 21*b* and 22*a*, 22*b*. Jaw elements 21 are eccentrically mounted on an axle 23 for rotation therewith, while jaw elements 22 are eccentrically mounted on an axle 24 likewise for rotation therewith. The jaw elements of the opposed jaws have inwardly converging gripping surfaces 25 (see FIG. 6) with gripping teeth 26 thereon as typically shown in FIG. 7 for one of the jaw elements 22*a*. Also, the outer free ends of each gripping elements are arcuately shaped as at 27, and teeth 26** extend radially from these arcuate edges.

Jaws 18 and 19 are respectively mounted for pivotable movement about their axes between a touching position of FIG. 4 and an open position upwardly and away from one another. The gripping jaws abut one another at their free ends to avoid further downward pivotable movement as typically shown in FIG. 4 and they are spring urged toward this position. Sprocket wheels 28 and 29 are respectively mounted on axles 23 and 24 for rotation herewith. A sprocket chain 31 engages these sprocket wheels as in the manner shown in FIG. 3, and a free end 32 thereof is connected to a light coil spring 23 which is mounted on a bracket 34 of the device. The opposite free end 35 of the sprocket chain is connected to a heavier coil spring 36 which is in turn connected to an upright 37 mounted on a portion of the device. Also, a lever arm 38 is fixedly mounted on axle 23 so that upon rotational movement of this lever arm away from well pipe P, both gripping jaws are rotated away from one another against the force of coil spring 36.

As pointed out hereinabove gripping device 13 is fixedly mounted on the apparatus near the lower end thereof, while gripping device 14 is mounted on the device for movement along uprights 11. Accordingly, extensions 39 and 41 are provided for gripping device 14, each of such extensions having cutout portions 42 and 43 which snugly embrace portions of uprights 11 so as to permit the gripping device to be guided therealong. Since uprights 11 are generally cylindrical cutouts 42 and 43 are likewise circular as clearly shown in FIG. 3.

Figure 2A:
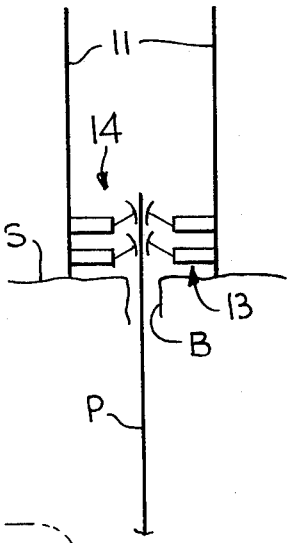
FIGS. 2A, 2B and 2C are schematic illustrations of the process used in extracting a well pipe with the present apparatus.
Figure 2B:
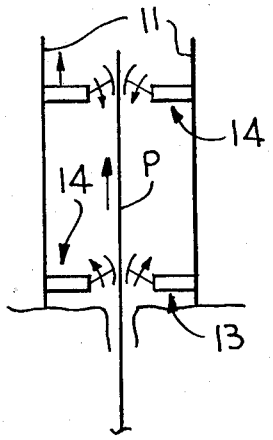
Figure 2C:
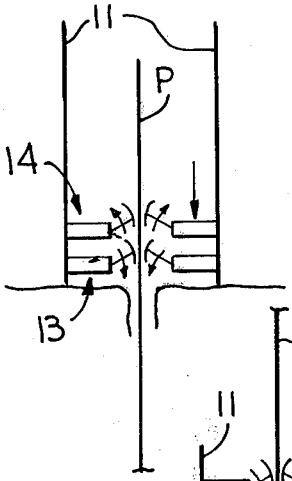

In operation, well pipe P may be extracted from well bore B as shown by reference to the schematic illustrations of FIGS. 2A, 2B and 2C. After the well pipe has been made to extend slightly above ground surface S, jaw members 18 and 19 of gripping device 13 embrace the well pipe so as to clamp it against relative downward movement (i.e., against pipe movement in a direction causing the jaw to close) by reason of its jaw members being eccentrically mounted and closely adjacent one another as in the manner aforedescribed. Gripping device 14 is then lowered upon the actuation of the hydraulic pistons 15 until its jaw members likewise embrace the well pipe as shown in FIG. 2A. Gripping device 13 is thereafter elevated upon hydraulic actuation of pistons 15 so as to thereby extract the well pipe out of its well bore as shown in FIG. 2B. During such movement of gripping device 14, its jaw members tightly grip the well pipe as the gripping teeth engage the peripheral surface of the pipe. Any slippage between the jaw members of gripping device 14 and the well pipe is avoided by reason of the eccentrically mounted jaw members which constantly bear against the well pipe toward a closed position by reason of the upward movement of the device 14 in a direction opposite the dead weight force of the pipe. Also, it can be seen that the gripping jaws of device 14 offer no resistance to upward movement of the well pipe since the jaw members thereof are caused to move slightly away from each other in the direction of the arrows of FIG. 2B by reason of the eccentricity of the jaw members. After a section of the well pipe is extracted to a position shown in FIG. 2B, gripping device 14 must again be lowered to its position of FIG. 2C for further extracting the well pipe from its well bore. The jaw members of the gripping devices therefore function oppositely as described for the extraction process in FIG. 2B, while gripping device 14 is being lowered as in FIG. 2C. Hence, as device 14 is begun to be lowered, the grip on the well pipe is released while the grip of the device 13 jaw members is tightened about the well pipe at the same time. Since device 13 is fixed in place, relative downward movement of the well pipe under its own weight causes the jaw members of device 13 to move toward a closed position so as to thereby clamp the well pipe against downward movement. On the other hand, the jaw members of device 14 are caused to move toward an open position away from one another while this device is being lowered. Further extraction of the well pipe may therefore be carried out as device 14 is again elevated similarly as described with reference to FIG. 2A.

Figure 2D:
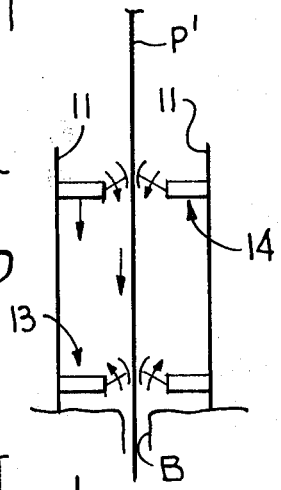
FIGS. 2D, 2E and 2F are schematic illustrations of the manner in which a well pipe is installed into the ground with the use of the present apparatus.

In order to install a well pipe P′ into well bore B, gripping device 14 is moved into its elevated position of FIG. 2D whereby its jaw members tightly grip the well pipe since the jaw members have a tendency to move toward a closed position as the static weight of the well pipe effects a downward force relative to device 14. Well pipe P′ may be installed into the well bore by simply lowering gripping device 14 so as to permit the well pipe to continue its downward and unobstructed movement at a controlled rate effected by the rate at which device 14 is lowered. It should be pointed out that the well pipe during installation is not fed into the well bore under any force exerted by gripping device 14. The well pipe is simply lowered under its own weight but at a controlled rate equal to that at which device 14 is lowered. Also, during such installation, lever 38 of gripping device 13 is actuated so as to move the gripping jaws thereof away from one another in the direction of the arrows of FIG. 2D. This may be simply effected by the operator stepping down on lever 38 with his foot.

Figure 2E:
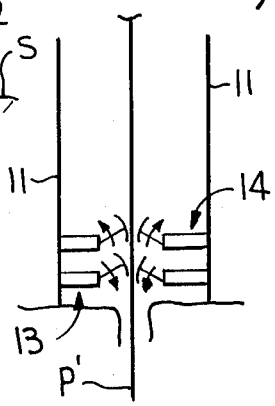
Figure 2F:
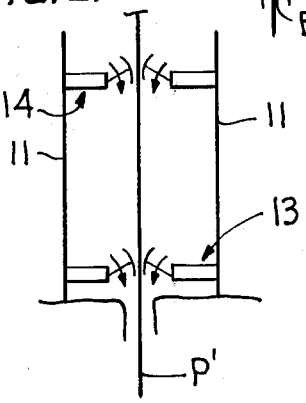

After device 14 has been lowered to its position of FIG. 2E, its lever 38 is actuated so as to move its gripping jaws away from one another as in the direction shown by the arrows of this Figure, so as to permit elevation of device 14 to its position of FIG. 2F. While device 14 is being so elevated, the jaws of gripping device 13 is urged into a closed position in response to the downward force of P′. After device 14 reaches its fully elevated position, well pipe P′ may be continued to be installed similarly as described with reference to FIG. 2D. This cycle of operation is continued until a pre-determined length of the well pipe is installed.

For the foregoing it can be seen that both extraction and installation of the well pipe from and into a well bore is made possible with an apparatus having gripping devices thereon which function together during both the extraction and installation operations. The gripping jaws of the devices need not be actuated into their closed positions since they are eccentrically mounted at opposite sides of the well pipe so as to naturally move toward a closed position upon relative opposing movement of the well pipe. Hydraulic or similar actuation means are merely provided for raising and lowering gripping device 14.

Obviously, many modifications and variations of the present invention are made possible in the light of the above teachings. It is therefore to be understood that within the scope of the appended claims the invention may be practiced otherwise than as specifically described.

What is claimed is:

1. An apparatus for both extracting and installing a well pipe respectively from and into the ground, comprising a vertically disposed support structure, a first well pipe gripping device fixedly mounted on said structure near the lower end thereof, a second well pipe gripping device mounted on said structure for vertical movement therealong, means for moving said second device toward and away from said first device, said devices each including a pair of opposed jaws having gripping teeth thereon, said jaws being eccentrically mounted for pivotal movement toward and away from one another, spring means resiliently urging said jaws into a closing and pipe gripping position toward one another, said jaws being respectively mounted on axles having sprocket wheels thereon, a sprocket chain having free opposite ends and engaging said wheels, said spring means connecting one of said ends to a portion of each of said devices, and means actuating said sprocket wheels for moving said jaws into an open position away from one another, said jaws having arcuately shaped free ends closely adjacent one another with gripping teeth thereon for clamping the well pipe against relative movement causing said jaws to close, whereby extraction of the well pipe is effected upon upward movement of said second device while clamping the pipe with its jaws, said jaw of said first device permitting relative upward movement of the pipe and effecting a clamping action of the pipe as said second device is moved downwardly to again grip the pipe, and whereby a lowering of the well pipe is effected under its own weight upon downward movement of said second device while clamping the pipe with its jaws, said jaws of said first device being moved away from one another by said moving means to permit lowering of the pipe below said first device.

2. The apparatus according to claim 1, wherein each of said jaws includes a pair of cooperating jaw elements having inwardly sloping surfaces converging inwardly from said free ends, said gripping teeth being located on said surfaces, whereby said jaws can accommodate pipes of various diameters therebetween.

3. An apparatus for both extracting and installing a well pipe respectively from and into the ground, comprising a vertical support structure, first and second well pipe gripping devices respectively mounted fixedly and for vertical sliding movement on said structure, said first device being located near the lower end of said structure, said devices each including a pair of opposing gripping jaws having outer free ends defining cooperating well pipe gripping surfaces having gripping teeth thereon for clamping the well pipe, said jaws being eccentrically mounted for pivotal movement of said gripping teeth on said opposing jaws between a closed position gripping the pipe and an open position, said jaws acting to clamp the pipe against relative movement causing said jaws to close, spring means for normally urging said jaws into a closed position, said jaws being respectively mounted on axles having sprocket wheels thereon, a sprocket chain having free opposite ends and engaging said wheels, said spring means connecting one of said ends to a portion of each of said devices, means actuating said sprocket wheels for moving said jaws into an open position against the force of said spring means, and means for moving said second device vertically along said structure, whereby extraction of the well pipe is effected upon upward movement of said second device with said jaws thereof gripping the pipe, said jaws of said first device gripping the pipe against downward movement as said second device is moved downwardly to again grip the pipe for further extraction, and whereby the well pipe may be installed into the ground as it lowers under its own weight upon movement of said jaws of said first device away from one another during downward movement of said second device.

4. The apparatus according to claim 3, wherein said outer free ends of said jaws terminate in arcuately shaped edges, and said gripping surfaces on said opposing jaws respectively converge inwardly from said edges.

5. A well pipe gripping device, comprising a pair of opposing gripping jaws having gripping teeth on opposed surfaces thereof, said jaws being eccentrically mounted for rotational movement between a closed position facing one another and an open position rotated in one direction, spring means resiliently urging said jaws into said closed position, said jaws being respectively mounted on axles having sprocket wheels thereon, a sprocket chain having free opposite ends and engaging said wheels, said spring means connecting one of said ends to a portion of the device, said surfaces of said jaws respectively converging inwardly from outer side edges thereof, said side edges being arcuately shaped and defining corners respectively abutting against one another for preventing rotation of said jaws from said closed position into a direction opposite said one direction, and said gripping teeth extending radially inwardly from said side edges, whereby pipes of various diameters may be gripped by said jaws.

* * * * *

Dedication 3,998,428.—*Erwin Zurcher,* Geneva, Switzerland. PROCESS AND APPARATUS FOR CONTINUOUSLY MEASURING THE VALUE OF THE TENSION IN A FILAMENT BEING DISPLACED FROM ONE POINT TO ANOTHER. Patent dated Dec. 28, 1976. Dedication filed Mar. 26, 1984, by the assignee, *Battelle Memorial Institute.*

Hereby dedicates to the People of the United States the entire remaining term of said patent.

[*Official Gazette May 22, 1984.*]